US010164314B2

(12) United States Patent
Butscher et al.

(10) Patent No.: US 10,164,314 B2
(45) Date of Patent: Dec. 25, 2018

(54) ANTENNA MODULE

(71) Applicant: Kathrein-Werke KG, Rosenheim (DE)

(72) Inventors: Florian Butscher, Aschau im Chiemgau (DE); Simon Stachler, Rosenheim (DE); Johann Frisch, Ruhpolding (DE); Gerhard Vogt, Rosenheim (DE)

(73) Assignee: Kathrein SE, Rosenheim (DE)

( * ) Notice: Subject to any disclaimer, the term of this patent is extended or adjusted under 35 U.S.C. 154(b) by 218 days.

(21) Appl. No.: 14/967,089

(22) Filed: Dec. 11, 2015

(65) Prior Publication Data

US 2016/0172746 A1 Jun. 16, 2016

(30) Foreign Application Priority Data

Dec. 11, 2014 (DE) ..... 10 2014 018 428

(51) Int. Cl.
*H01Q 1/32* (2006.01)
*H01P 3/16* (2006.01)

(52) U.S. Cl.
CPC ..... *H01P 3/16* (2013.01); *H01Q 1/3275* (2013.01)

(58) Field of Classification Search
CPC ..... H01Q 1/12; H01Q 1/32; H01Q 1/325; H01Q 1/3275; H01Q 1/42
See application file for complete search history.

(56) References Cited

U.S. PATENT DOCUMENTS

| | | | | |
|---|---|---|---|---|
| 2008/0131199 | A1* | 6/2008 | Hildebrand | H01Q 1/1214 403/408.1 |
| 2014/0028507 | A1 | 1/2014 | Mierke et al. | |
| 2015/0123854 | A1 | 5/2015 | Chakam et al. | |

FOREIGN PATENT DOCUMENTS

| | | | |
|---|---|---|---|
| DE | 102004045107 | A1 | 3/2006 |
| DE | 102006050406 | A1 | 4/2007 |
| DE | 102010012582 | A1 | 10/2010 |
| DE | 102011016294 | A1 | 10/2012 |
| DE | 102012208303 | A1 | 11/2013 |
| EP | 2234199 | A1 | 9/2010 |
| JP | 2013252790 | A | 12/2013 |
| WO | 2006029939 | A1 | 3/2006 |

* cited by examiner

*Primary Examiner* — Tho G Phan
*Assistant Examiner* — Patrick Holecek
(74) *Attorney, Agent, or Firm* — McCoy Russell LLP

(57) ABSTRACT

The present disclosure relates to an antenna module for installing at an opening of a vehicle roof, wherein the antenna module can be arranged at the opening and can be latched there via at least one spring element, wherein the fastening of the antenna module can be secured to the vehicle roof via a locking element which, in its locking position, blocks a resilient backward movement of the spring element out of the latched position.

19 Claims, 12 Drawing Sheets

ANTENNA MODULE

CROSS REFERENCE TO RELATED APPLICATION

This application claims priority to German Patent Application No. 10 2014 018 428.5, entitled "Antenna Module," filed on Dec. 11, 2014, the entire contents of which is hereby incorporated by reference in its entirety for all purposes.

TECHNICAL FIELD

The present disclosure relates to an antenna module for installation at an opening of a vehicle roof.

BACKGROUND AND SUMMARY

Antenna modules are used in the field of automotive technology to provide a motor vehicle roof antenna. The antenna modules typically have a chassis at whose upper side one or more antennas are arranged and which is fastened to an opening in the vehicle roof. The antenna modules are typically suitable for operation in the mobile communications sector and/or for the reception of radio programs. Reception systems for determining the position of an automobile, in particular GPS receivers, and/or receivers for a radio key system of the vehicle, can furthermore be accommodated in such an antenna module.

Different technologies are used for installing the antenna module at the opening of the vehicle roof. An antenna module is thus known from DE 10 2011 016 294 A1 in which the chassis of the antenna module is arranged at the outside of the vehicle roof and is screwed to it. An antenna module whose chassis is arranged at the outside on the vehicle roof is likewise known from DE 10 2006 050 406 A1. The fastening then takes place via a counter-element which is screwed to the chassis from the passenger compartment of the vehicle through the opening of the vehicle roof so that the margin of the vehicle roof is clamped between the chassis and the counter-element.

An antenna module which can be inserted into the opening of the vehicle roof from the passenger compartment is furthermore known from DE 10 2012 208 303 A1. In this respect, the antenna module has a horizontal groove at one side which is pushed onto a rim of the opening and has latch elements which allow a pre-latching of the antenna module at the opening. The final fastening then takes place by screwing to the vehicle roof.

An antenna module is furthermore known which is placed on the opening of the vehicle roof from the outside and which has sheet metal hooks which are pushed through the opening in the vehicle roof and allow a pre-latching of the antenna module. The sheet metal hooks can in this respect be pulled into the chassis of the antenna module via a screw which can be actuated from the passenger compartment of the vehicle. The latching edges of the sheet metal hooks are drawn toward the panel of the vehicle roof by actuating the screw and cut into said panel so that a secure connection is likewise produced.

However, some disadvantages remain in the known systems for installing the antenna module at the vehicle roof. The systems have the disadvantage, for example, that they do not allow any non-destructive dismantling of the antenna module. The installation is furthermore frequently complex and requires the use of tools. They are additionally sometimes of a complicated design.

It is the object of the present disclosure to provide an antenna module improved with regard to the installation at the opening of the vehicle roof.

This object is achieved in accordance with the present disclosure by an antenna module for installation at an opening of a vehicle roof which can be arranged at the opening and which can be latched there via at least one spring element. In accordance with the present disclosure, the fastening of the antenna module to the vehicle roof can in this respect be secured via a locking element which, in its locking position, blocks a resilient backward movement of the spring element from the latched position. The spring element thus not only serves the pre-latching of the antenna module to the vehicle roof, but also fixes the antenna module finally thereto. A release of the antenna module is prevented in this respect via the locking element which blocks the spring path of the spring element and thus secures the latching. The antenna module in accordance with the present disclosure thus allows a particularly simple installation at the opening of the vehicle roof and nevertheless has a simple design.

The locking element can optionally be actuated from the same side from which the antenna module can also be arranged at the opening of the vehicle roof. The final fastening of the antenna module can thus take place from the same side as the pre-latching at the opening so that a particularly simple installation is produced. The construction in accordance with the present disclosure with a locking element which blocks the spring path of the spring element allows such a fastening with a small construction effort.

In a possible embodiment of the present disclosure, the antenna module can be arranged at the opening of the vehicle roof from the vehicle interior. The antenna module can in this respect in particular be inserted into the openings from the inside. In a further, embodiment, the locking element can be actuated from the interior of the vehicle. In this respect, both the arrangement of the antenna module and the actuation of the locking element may take place from the interior of the vehicle. A particularly simple installation is hereby ensured.

A one-handed installation is possible by the pre-latching provided by the spring element on an arrangement at the opening since the antenna module does not have to be held by the installer for the actuation of the locking element, but is rather already provisionally secured in the opening.

The locking element in accordance with the present disclosure can be actuated in a tool-free manner. The locking element can in this respect in particular be able to be actuated by a tool-free displacement and/or rotation. This is also only possible due to the use in accordance with the present disclosure of a locking element which blocks the spring path of the spring element.

The locking element may be releasably fixed to the antenna module in the locking position, for example by latching, by self-locking and/or by clamping. It is hereby prevented that the locking element releases itself in operation and unblocks the locking. If the antenna module is to be dismantled, the locking can, in contrast, also be released again.

The locking of the spring element by the locking element can further be releasable in a non-destructive manner. The locking element may be fixed in its locking position via a latch connection for this purpose which can be released to move the locking element out of its locking position.

The fastening of the antenna module by the spring element can furthermore be releasable in a non-destructive manner. For this purpose, the spring element can be moved out of the latched position against its spring force after the movement of the locking element out of the locking position. For this purpose, the spring element and/or a contact region of the spring element may be accessible from the installation side for which purpose an aperture can be provided at or through the chassis of the antenna module.

The locking of the spring element can be released from the interior of the vehicle by the locking element. The fastening of the antenna module by the spring element can further also be released from the interior of the vehicle. The releasability of the locking element or of the fastening from the interior of the vehicle has the advantage that an outer protective cover of the antennas, which is typically adhesively bonded to the vehicle roof, does not have to be removed to replace the antenna module.

In an embodiment of the present disclosure, the spring element is preloaded into an intermediate position in which it provisionally secures the antenna module after the arrangement at the opening of the vehicle roof, wherein the spring element is only moved against its spring force by the locking element from this intermediate position into an end position in which it permanently fixes the antenna module to the vehicle roof. This has the advantage that only a relatively small force has to be applied for the insertion of the antenna module into the opening since the spring does not have to be pressed out of its end position for this purpose but rather only has to be pressed out of its intermediate position into an introduction position. The spring element in this respect can establish a clamping connection to the vehicle roof in its end position in which it is pressed by the locking element.

The locking element in accordance with the present disclosure may be movable into the spring path of the spring element to block it. It is hereby ensured that movements of the spring element out of its latched position and in particular out of the end position, in which the spring element permanently fixes the antenna module, are blocked. The locking element is in this respect moved into the spring path in a direction which extends transversely to the direction of the spring movement of the spring element. The force which the locking element exerts on the spring element hereby acts transversely to the direction of movement of the latching element.

The latching element can be movable from an installation position in which it permits a resilient movement of the spring element into its locking position. As long as the locking element is therefore in its installation position, the spring element can be moved and thus allows the pre-latching of the antenna module. In contrast, the spring element is blocked in the locking position of the locking element.

In this respect, in possible embodiments of the present disclosure, the locking element can be arranged displaceably or rotatably at the antenna module. The locking element can therefore in particular be a sliding element and/or an eccentric element.

If an eccentric element is used, it can be rotated by a rotary movement into the locking position in which its eccentric pressure surface presses onto a spring arm of the spring element and thus blocks it and/or moves it into its end position. The eccentric element in this case has a flat point with which it lies on the spring arm in the locking position and is hereby secured in this position in a self-locking manner. The eccentric element can in this respect, for example, be designed as a rotary knob with a cam.

If a sliding element is used, it can be displaceable into the locking position in a direction which extends transversely to the direction of the spring movement of the spring element. The force which the locking element exerts on the spring element hereby acts transversely to the direction of movement of the latching element. The locking element is in this respect fixed in the locking position in a latchable and/or clamping manner.

The locking element can in this respect represent a separate component which is releasably connectable to the antenna module. It is conceivable in this respect that the locking element is only connected to the antenna module after the latching of the antenna module to the vehicle roof. The locking element is, however, already fastened to the antenna element in the installation position.

It is in this respect in particular a releasable fastening of the locking element to the antenna module so that the locking element can be replaced simply. The fastening of the locking element in the installation position in this respect takes place by a pre-latching. The locking element can, however, also be arranged unreleasably at the antenna module and can, for example, be rotatably supported thereat.

The locking element in accordance with the present disclosure can have at least one latching arm with which it can be latched to the antenna module. The latching arm can in this respect provide a pre-latching in the installation position and/or an end latching in the locking position. Two latching arms are in this respect provided at oppositely disposed sides of the locking element. The latch connection can be released by pressing the latching arms together, for example using pliers.

The locking element can in this respect may be pre-latched in an installation position and fixed in its locking position via the latching arm at respective different latching edges of the antenna module. The first latching edge is in this respect arranged at a cap of the antenna module and the second latching edge is arranged at a chassis of the antenna module. The latching arm is releasable from its latching position using a tool to move the latching element back out of the locking position and/or to release the locking element from its installation position at the antenna module.

The spring element in accordance with the present disclosure can have a latching edge with which it engages around a counter-edge in its latched position. In its end position, the spring element in this respect enters into a clamping connection with a counter-edge, for example with the panel of the vehicle roof. The latching edge of the spring element can in this respect in particular be pressed against the counter-edge by the locking element.

The spring element can furthermore have a run-on chamfer which comes into contact with a counter-edge on the pushing of the antenna module into the opening of the vehicle roof and via which the spring element is deflected. The run-on chamfer has a ramp shape for this purpose. The spring element is deflected so far by the run-on chamfer that the latching edge is moved past the counter-edge and springs back there through the spring force into a latched position in which the latching edge engages around the counter-edge.

The spring element in accordance with the present Disclosure does not necessarily have to be a part of the antenna module or be fastened thereto. The spring element can rather also be arranged at the vehicle roof and latch with a counter-edge of the antenna module when it is arranged at the opening of the vehicle roof.

The spring element is, however, arranged at the antenna module and cooperates with a counter-edge of the vehicle roof. The latching edge of the spring element can in this respect in particular engage around a rim of the opening of the vehicle roof. Only a correspondingly shaped opening for the antenna module hereby has to be provided in the vehicle roof, whereas all the elements of the installation apparatus are arranged at the antenna module.

The latching edge engaging around the rim of the opening of the vehicle roof in this respect clamps the panel of the vehicle roof in the end position. For this purpose, the antenna module has a counter-element which cooperates with the latching edge, wherein a slit is provided between the latching edge and the counter-element in which the rim of the opening of the vehicle roof comes to lie on the establishing of the latched connection. On a movement of the spring element into the end position, the height of the slit is in this respect reduced so that a clamping of the vehicle roof is provided.

In accordance with the present disclosure, the spring element can in this respect at least partly comprise spring steel, with the latching edge being formed by a chamfer of the spring steel. A further chamfer of the spring steel provides the run-on chamfer. A contact edge by which the spring element can be released from the latch position can likewise be provided by an angled portion or by a free end of the spring steel. It is a leaf spring in this respect.

A spring arm of the spring element in this respect extends from a fastening region over a U-shaped bent portion to the free end of the spring element in whose region the latching edge is provided. The length of the spring arm is hereby increased.

In the locking position, the locking element is arranged at the side of the spring arm and in particular of the leaf spring disposed opposite the latching edge and hereby blocks the movement of the spring arm out of the latched position. The locking element can in this respect be movable along the spring arm and in particular along the leaf spring into the locking position.

In a possible, embodiment of the present disclosure, the antenna module has a guide along which the locking element is displaceable into the locking position. This allows a particularly simple actuation of the locking element, wherein the locking element is displaceable along the guide by hand.

The guide can in particular be a guide passage in which the locking element is displaceable. The locking element can particularly in this respect be pressed into the guide passage. The guide passage can in this respect have a guide rail or a guide groove which cooperates with a guide groove or a guide rail of the locking element. The movement of the locking element is hereby guided within the guide passage.

In a preferred embodiment, the spring element in this respect extends at a side of the guide passage and is contacted by the locking element in the locking position thereof. The spring element can in this respect in particular have a spring arm which extends at a side of the guide passage.

The locking element is formed by a pusher which is displaceable obliquely to the extent of a spring arm of the spring element in a guide and is thus pressed against the spring arm of the spring element on a displacement into its locking position. The guide can in this respect in particular be formed by a ramp-shaped wall of a guide passage which is disposed opposite the spring arm. Alternatively or additionally, the locking element can have a wedge shape. The locking element is pressed against the spring arm by the pressing of the locking element into the guide passage.

The locking element can also have a run-on chamfer by which it contacts the spring element and presses it into its end position. In this case, the locking element can also be displaceable transversely to the direction of extent of the spring arm of the spring element.

The locking element in accordance with the present disclosure can have an elastic element with which it is supported against the guide passage and/or the spring element to achieve a wobble-free seat of the locking element in the installation position. The elastic element can, for example, be a spring arm of the locking element which is in contact with a wall of the guide passage and/or with the spring element in the installation position and hereby avoids a wobbling of the spring element in the installation position.

The locking element in accordance with the present disclosure can cooperate with a counter-element in a possible embodiment to fix the spring element in a fixed position. The locking element in this respect, if it is moved into its locking position, presses the spring element against the counter-element so that the spring element is pressed between the locking element and the counter-element in the locking position of the locking element. The spring element in this position is in its end position in which its permanently fixes the antenna module to the vehicle roof. This simultaneously provides a certain clamping of the locking element in the locking position.

In a possible embodiment of the present disclosure, a plurality of spring elements in accordance with the present disclosure can be provided which allow a pre-latching of the antenna module to the vehicle roof and can be locked via a common locking element or via respective locking elements provided separately. Such a plurality of spring elements in accordance with the present disclosure are in this respect arranged at the antenna module.

It is furthermore possible in accordance with the present disclosure that, in addition to the spring element in accordance with the present disclosure, further latching elements are provided which are, however, not blockable. They then only serve a pre-latching of the antenna module to the vehicle roof.

In a possible embodiment of the present disclosure, the antenna module can in this respect be pushed into the opening of the vehicle roof and can be latched there, at least two spring elements in accordance with the present disclosure being provided by whose blocking the antenna module is then finally fixed to the vehicle roof.

In a preferred embodiment of the present disclosure, the antenna module in contrast comprises at least one holding element which engages around a rim of the opening of the vehicle roof. This holding element in this respect, together with the spring element in accordance with the present disclosure, allows a secure fastening of the antenna module to the opening of the vehicle roof. The holding element at the antenna module is arranged at the side disposed opposite the spring element with respect to the opening so that the holding element and the spring element fasten the antenna module to the opening at oppositely disposed sides thereof.

The holding element can be of a rigid design in this respect. The holding element can in this respect have an edge by which it can be laterally pushed onto a rim of the opening of the vehicle roof. The installation of the antenna module can in this respect in particular take place in that the antenna module with the holding element is first pushed onto a rim of the opening of the vehicle roof and is then pushed by a pivot movement about the fixing presented by the holding element into the opening until the spring element latches in and provisionally secures the antenna module.

A ramp can in this respect be associated with the edge formed by the holding element so that the edge of the vehicle roof is clampingly fixed by the pushing on. Alternatively or additionally, the ramp can allow a pivot movement of the antenna module about the fixing presented by the holding element.

The antenna module in accordance with the present disclosure has a chassis which carries one or more antennas at its upper side. The chassis can in this respect in particular consist of metal or can at least comprise a metallic layer. The chassis is arranged with a peripheral region beneath or on the vehicle roof after the fastening of the antenna module, depending on whether the installation takes place from the interior of the vehicle or from the outside. If the chassis is composed of metal or if it has a metallic layer, an electrically conductive plane is hereby also given in the region of the opening of the vehicle roof The chassis can have a base region with which it passes through the opening in the vehicle roof. A secure fitting of the chassis into the opening is hereby ensured. One or more antennas are arranged on this base region.

The chassis can have coupling elements in its peripheral region via which it is electrically coupled to the vehicle roof. The coupling elements are flexible in this respect to ensure a good coupling to the vehicle roof. The coupling in this respect takes place capacitively. The coupling elements are arranged between the upper side or lower side of the chassis and the vehicle roof after the fastening of the antenna module. Alternatively, a galvanic contact would be possible, for example via cutting teeth which cut into the panel of the vehicle roof and thus establish a galvanic connection.

The antenna module can furthermore have a cover for the one or more antennas fastenable to the upper side of the chassis. The cover thus protects the antennas from damage.

The chassis can furthermore have a cap which closes it downwardly.

The cover and/or the cap are produced from plastic.

The antenna module has at least one cellular radio antenna. Alternatively or additionally, an antenna can be provided via which the signal of a radio key for the vehicle locking can be received. Alternatively or additionally, an antenna for the reception of radio programs can be provided. Further alternatively or additionally, a reception antenna for a global positioning system can be provided, for example a GPS receiver. The antennas can in this respect be perpendicular on the chassis plane or can be arranged horizontally thereto. Cellular radio antennas and antennas for the radio key are in this respect typically arranged perpendicular; radio antennas or positioning antennas, in contrast, in parallel with the chassis surface.

Antennas can furthermore also be provided at the lower side of the chassis or within the box formed by the chassis and the cap, for example to provide a WLAN connection within the vehicle or for a radio key.

The antenna module has a mainboard which is arranged beneath the upper side of the chassis and is connected to the antennas arranged at the upper side of the chassis through apertures in the chassis.

The antenna module can furthermore comprises connection elements for connection to the vehicle electronics, in particular data plug-in connections for digital services and/or coaxial plug-in connections. The plug-in connections are in this respect arranged laterally at the chassis to reduce the construction height.

In accordance with a preferred embodiment of the present disclosure, the locking element is arranged displaceably in the antenna module transverse to the plane of extent of the vehicle roof and/or transverse to the main plane of a housing of the antenna module. The locking element can in this respect in particular be pressed into its locking position by being pressed into the antenna module or into the housing of the antenna module. The chassis and the cap in this respect form the housing of the antenna module.

In this respect, a guide passage for the locking element is provided which passes through the antenna module or the housing of the antenna module from the bottom to the top. The spring element can also be reached via this guide passage in order to move it out of its latched position and thus to release the connection of the antenna module to the vehicle roof In this respect, the spring element can have a contact edge via which it can, for example, be contacted via a screwdriver with shape matching to be moved out of the latched position in order to release the antenna module from the vehicle roof. The contact edge is in this respect accessible via the guide passage. The securing element can be removed from the guide passage for this purpose. The contact edge can in this respect be formed, for example, by the free end of the spring element produced from spring steel.

The spring element can furthermore extend over a side of the guide passage. Provision can be made in this respect that a spring arm of the spring element extends within the antenna module and the latching edge and run-on chamfer of the spring element project out of the upper side or lower side of the antenna module or of the housing.

The guide passage which passes through the antenna module from bottom to top is formed at the cap and/or chassis. The guide passage is in this respect open both toward the top and toward the bottom. The locking element can in this respect be introduced or displaced from the bottom. The upper opening of the guide passage allows an access to the contact edge of the locking element.

In accordance with the present disclosure, at least one holding element can furthermore be provided both at the chassis and at the cover, said holding elements engaging around a rim of the opening of the vehicle roof. They are in this respect holding elements as already described above. The holding element at the chassis can in this respect be configured as a metallic hook; the holding element at the cover, in contrast, as a plastic hook or plastic edge. The holding element at the chassis is held out of contact with the vehicle roof by the holding element at the cover. It is hereby prevented that the holding element at the chassis scratches the paintwork of the vehicle roof. If, however, the holding element of the cover breaks, the holding element of the chassis provides a secure fastening of the antenna module to the vehicle roof. A ramp which is associated with the holding element can furthermore be provided at the cover. The ramp in this respect together with the holding element produces a clamping of the vehicle roof. The ramp can furthermore be designed such that it allows a pivoting of the antenna module into the opening. The ramp additionally simplifies the correct pushing of the holding element onto the margin of the vehicle roof.

In addition to the antenna module in accordance with the present disclosure, the present disclosure furthermore comprises a method of installing an antenna module.

The method in accordance with the present disclosure of installing an antenna module at an opening of a vehicle roof provides that the antenna module is inserted into the opening and is latched via at least one spring element there. In this respect, after the latching of the spring element, a locking element is moved into a locking position in which it blocks a resilient backward movement of the spring element from its latched position.

The spring element is in this respect moved from an intermediate position in which it provisionally secures the antenna module at the vehicle roof into an end position in which it permanently fixes the antenna module. The spring element clamps the automobile roof in this end position.

The antenna module is in this respect installed from the vehicle interior, with the locking element also being actuated from the vehicle interior. The installation of the antenna module and in particular the locking of the spring element in this respect take place in a tool-free manner.

The method in accordance with the present disclosure in this respect takes place as already shown in more detail above. An antenna module such as described above is furthermore used for the method. The spring element and the locking element can in this respect in particular be designed as already described above.

The present disclosure furthermore comprises a vehicle having a vehicle roof and an antenna module, such as already described above, attached to an opening of the vehicle roof.

The present disclosure will now be presented in more detail with reference to an embodiment and to a drawing.

DETAILED DESCRIPTION

The embodiment shown in the Figures of an antenna module in accordance with the disclosure can be installed at an opening in a vehicle roof to provide a motor vehicle roof antenna. The antenna module in this respect has a chassis 2 on whose upper side antennas 4, 4' are arranged which can be recognized, for example, in FIGS. 6 and 10 to 14. The antennas 4 can be PCB antennas, sheet-metal antennas or foil antennas. The antennas 4 in this respect stand perpendicular on the upper side of the chassis and are thus vertically oriented. The antennas 4 are in particular cellular radio antennas and/or antennas for the radio key system of the vehicle. In this respect, in the embodiment, the rear antenna 4 is configured as a cellular radio antenna including LTE 1, and for the radio key system. The front antenna is configured for LTE 2, in contrast. Antennas for global positioning systems and/or for the reception of radio programs and/or for C2C services and/or for C2X services can furthermore be provided. In the embodiment, antennas 4' extending in parallel with the direction of extent of the antenna module and thus extending substantially horizontally in the installed state are provided for this purpose.

Figure 6:
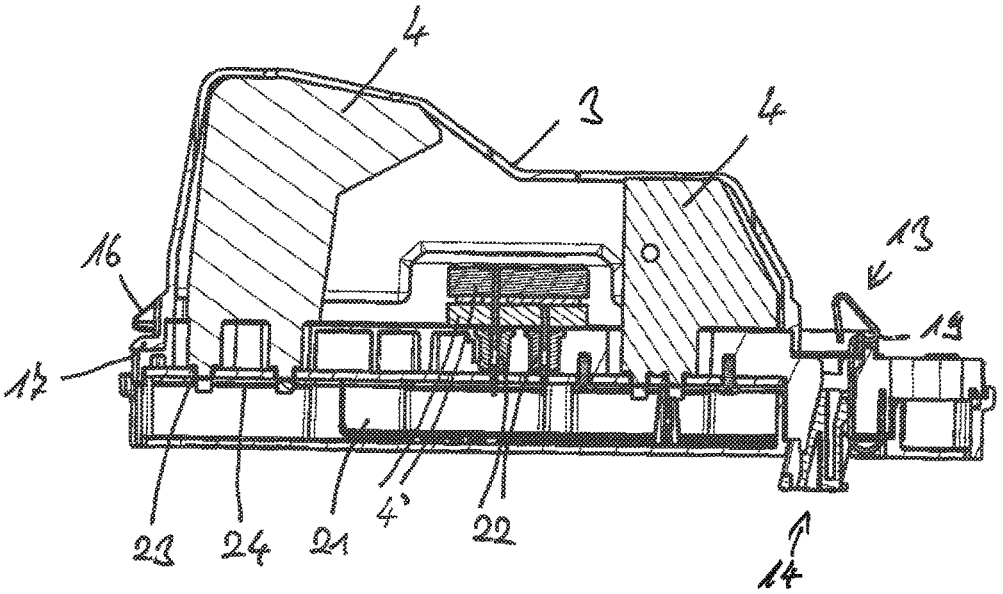
FIG. 6 shows the embodiment in a sectional view through its central plane.

As can be recognized in FIG. 6, a mainboard 24 is arranged within the chassis and the control and/or evaluation electronics are arranged on it. In the embodiment, the mainboard is equipped at both sides. The contacting of the antennas takes place by apertures in the upper side of the chassis 2. In this respect, regions of the printed circuit boards forming the antennas 4 extend through the chassis and are contacted to the mainboard in the region 23. The antennas 4', in contrast, are connected to the mainboard 24 by coaxial connectors 22.

As furthermore shown in FIG. 6, antennas 21 are also provided within the chassis 2 which serve the radio key system within the vehicle, for example, and/or which provide a WLAN connection within the vehicle. In this respect, they can be PCB antennas and/or sheet-metal antennas and/or foil antennas.

The antenna module has plug-in connections 6 and 6' to which the antennas and/or the electronics of the antenna module can be connected to the board electronics of the motor vehicle. Coaxial plug-in connectors 6 are provided for this purpose as well as a data plug-in connection 6' for digital services. The plug-in connectors are in this respect arranged laterally at the chassis to allow a low construction height and a simple contacting from the side.

The antenna module furthermore comprises a cover 3 for the antennas 4 and 4', the cover being able to be releasably fastened to the chassis 2. Latch elements 8 are provided for this purpose. The antenna module furthermore has a cap 5 which closes the lower side of the chassis 2. The cap is releasably connected to the chassis 2, for which purpose latch elements 7 are provided.

The chassis 2 is manufactured from metal in the embodiment, in particular as a die-cast component. The cover 3 and the cap 5 are produced from plastic in the embodiment, for example as injection-molded parts.

The embodiment of the antenna module in accordance with the present disclosure is installed from the vehicle interior. In the installed position of the antenna module, the chassis is in this respect, at least in its peripheral regions, beneath the vehicle roof. The electrical coupling to the vehicle roof in this respect takes place via coupling elements 11 which in the embodiment provide a capacitive coupling to the panel of the vehicle roof. The coupling elements 11 are in this respect composed of a conductive, flexible material and thus ensure a secure contact of the vehicle roof.

The chassis 2 has a base region 12 with which it passes slightly through the opening in the vehicle roof. The base region 12 in this respect substantially has the shape of the opening in the vehicle roof and thus secures the antenna module against a lateral slipping in the opening. The already described antennas 4 and 4' are arranged on the base and are covered by the cover 3.

For the fastening of the antenna module to the vehicle roof, the former has holding elements 15, 16—at its rear side in the embodiment—as well as a spring element 13 in accordance with the present disclosure oppositely disposed with respect to the opening—that is at the front in the embodiment.

The installation procedure now takes place in that the holding elements 15, 16 of the antenna module are first hung at the rim of the opening of the vehicle roof and are pushed toward the rim up to abutment. The antenna module is thereupon pivoted upwardly into the roof section until the spring element 13 latches and the antenna module is hereby secured against falling out. The spring element 13 in this respect has a latching edge 19 which engages around the rim of the opening of the vehicle roof in the latched position. The spring element 13 furthermore has a run-on chamfer 49 with which it comes into contact with the rim of the opening on the pivoting into the opening and is hereby deflected in the direction of the opening.

Projections 15 of the chassis 2 are provided as holding elements as are projections 16 of the cover 3. A ramp-shaped element 17 is provided at the cover 3 so that the roof panel is clamped between the projections 15 and 16 as well as the ramp 17 disposed opposite these projections with respect to the roof panel. The ramp shape in this respect additionally allows a simple pushing in and a pivoting of the antenna module without bending the roof panel.

The antenna module can be fastened to the roof panel without tools by the holding elements and the spring element. The spring element per se, however, does not represent any connection to the vehicle roof which is sufficiently safe in operation since the spring elements could in particular spring back from the latched position on high accelerations or on vibrations and would thus release the antenna module. This applies all the more since the spring force of the spring module cannot be increased as desired since it is restricted by the simple handling capability on the insertion.

A locking element 14 is therefore provided in accordance with the present disclosure. After the antenna module is inserted into the opening and latched thereto as described above, said locking element is moved into a locking position in which it blocks a resilient movement back of the spring element from the latched position.

Figure 7A:
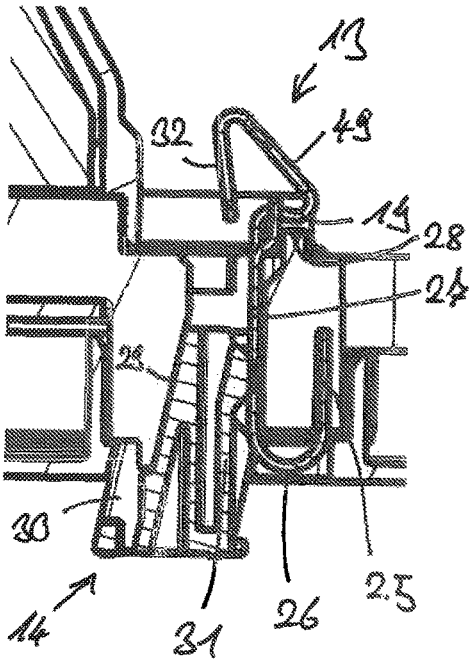
FIG. 7A shows a detail view of the spring element used in the embodiment and of the locking element, with the locking element in its installation position.
Figure 7B:
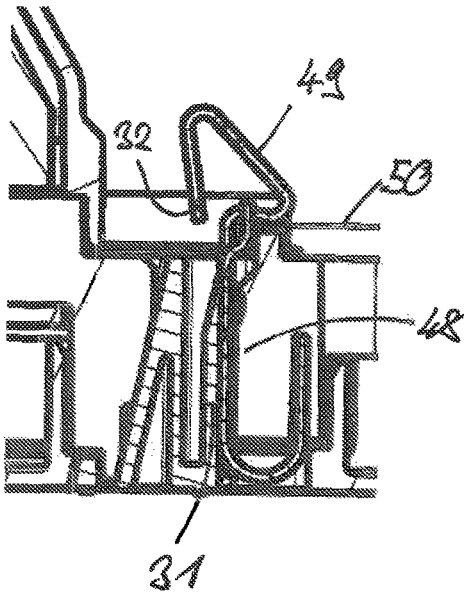
FIG. 7B shows a detail view of the spring element used in the embodiment and of the locking element, with the locking element in its locking position.

The function and the design of the locking element and of the spring element in this respect in particular result from FIGS. 7A and 7B.

The locking element is in an installation position in which the spring element 13 can be freely deflected in FIG. 7A. If therefore the run-on chamfer 49 of the spring element comes into contact with the edge of the roof panel, the spring element is deflected to the left out of the position shown in FIG. 7A so that its latching edge 19 passes through the opening. The spring element thereupon moves back due to Its spring force into its preloaded position which is shown in FIG. 7A such that the latching edge 19 is arranged above the margin of the roof panel 50 and thus provides a pre-latching.

The spring element is in this respect preloaded into an intermediate position which admittedly allows a pre-latching with the roof panel, but still allows a further deflection of the spring element in the direction of the margin of the roof panel. The forces which are required for the latching can hereby be kept small.

If the locking element is then pushed out of the installation position shown in FIG. 7A into the locking position shown in FIG. 7B, it presses the spring element 13 in the direction of the margin of the roof panel 50. The spring element 13 is hereby brought into the end position shown in FIG. 7B.

In this respect, the spring element is designed such that the latching edge 19 clamps the roof panel 50 in the end position of the spring element. For this purpose, the antenna module has a counter-element 28 beneath the latching edge 19 so that there is a small gap between the latching edge 19 and the counter-element 28, in which gap the roof panel comes to lie after the latching. If the spring element is pressed into its end position by the latching element, the height of the gap reduces so that the roof panel 50 is clamped between the latching edge 19 and the counter-element 28.

Figure 1:
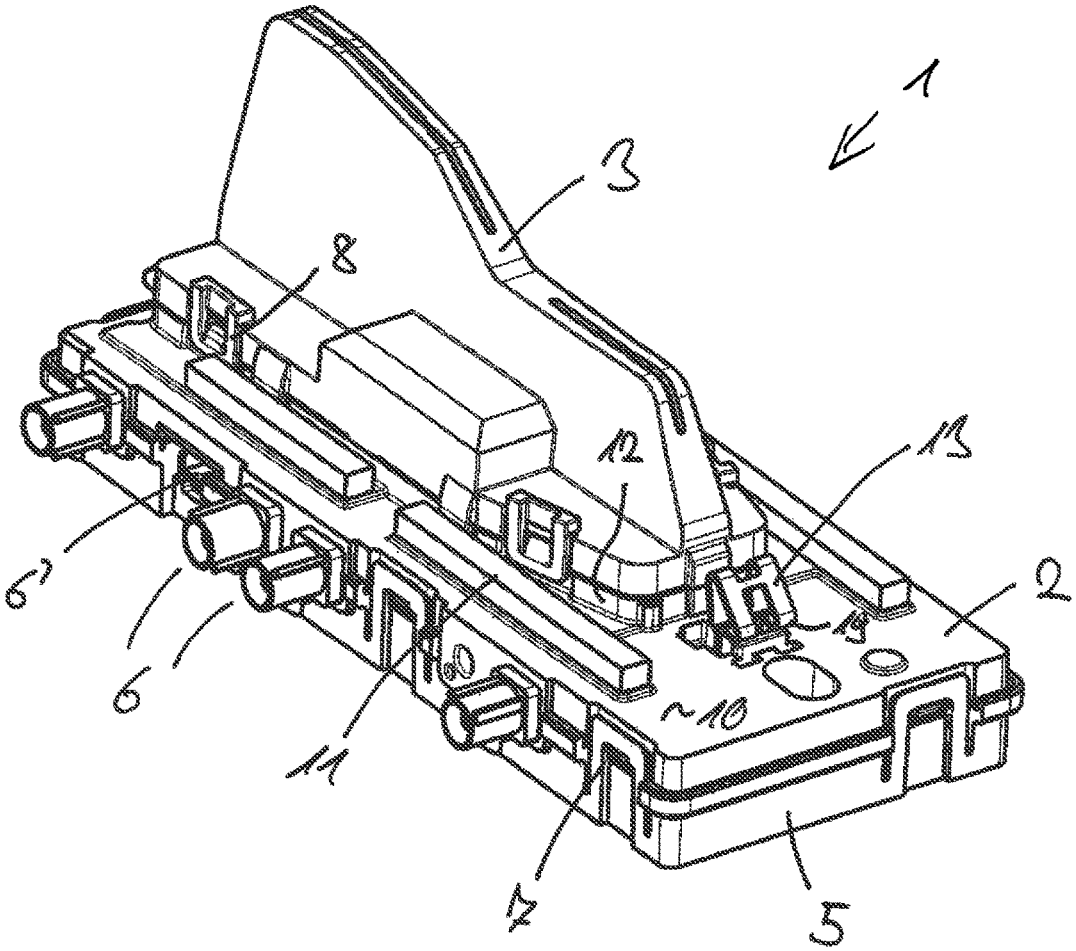
FIG. 1 shows the embodiment of the antenna module in accordance with the present disclosure in a perspective view obliquely from above and from the front.
Figure 2:
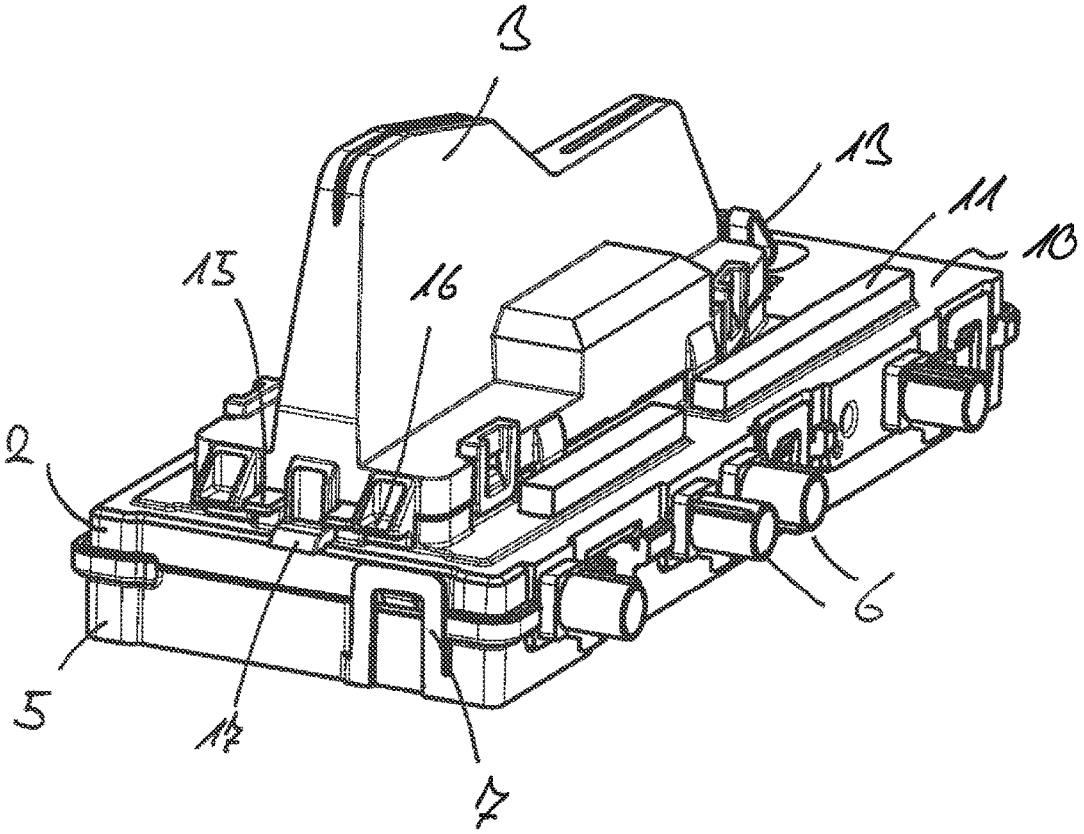
FIG. 2 shows the embodiment in a perspective view obliquely from above and from the rear.
Figure 3:
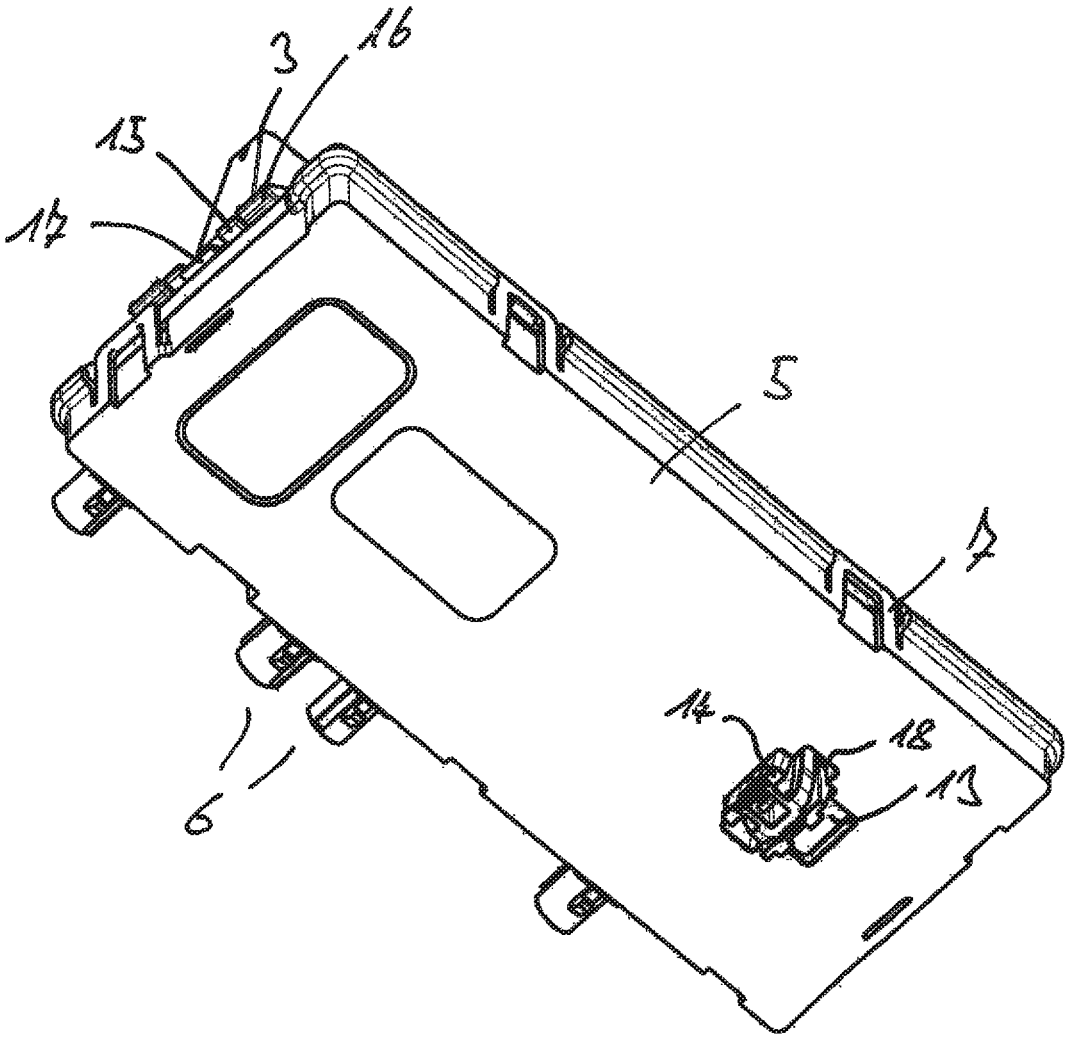
FIG. 3 shows the embodiment in a perspective representation obliquely from the bottom rear.
Figure 4:
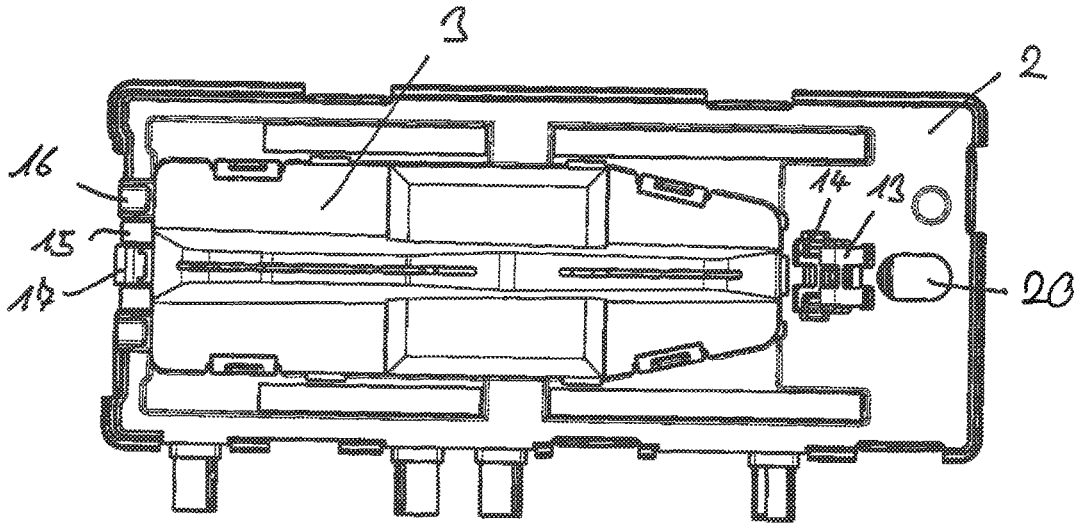
FIG. 4 shows the embodiment in a plan view from above.
Figure 5:
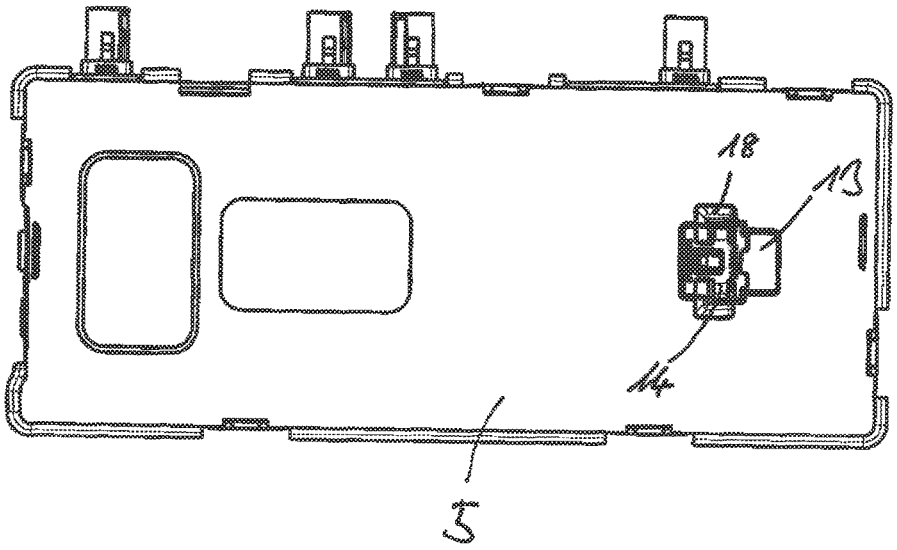
FIG. 5 shows the embodiment in a plan view from below.

The spring element 13 is in this respect fastened to the chassis 2 by a fastening region 25. For this purpose the chassis has a receiving groove in which the spring element formed from a volute spring is inserted and in which it is clamped. The spring element in this respect has a U-shaped arc 26 which is adjoined by the spring arm 27 extending from bottom to top. The effective length of the spring arm is hereby increased. The latching edge 19 and the run-on chamfer 49 are formed by corresponding chamfers of the leaf spring. A last chamfer of the leaf spring provides a contact edge 32 into which, for example, a screwdriver can be inserted to release the spring element from its latched position when the locking element 14 has been removed. As can be recognized in FIG. 1, for example, the leaf spring has a central cut-out extending in the longitudinal direction is some regions.

The locking element 14 is formed by a pusher which is displaceable in a guide passage 18 provided in the housing of the antenna module. As can, for example, be recognized in FIGS. 1, 7 and 10, the guide passage in this respect passes from bottom to top through the total housing of the antenna module which is here formed by the chassis 2 and the cover 5. The locking element can in this respect be pressed out of the installation position shown in FIG. 7A into the locking position shown in FIG. 7B by pressing the locking element 14 into the guide passage 18. If the locking element is, in contrast, completely removed from the guide passage, the contact edge 32 of the spring element is accessible from below and thus from the passenger compartment.

The spring arm 27 of the spring element in this respect forms at least a part of a side surface of the guide passage. The wall of the guide passage 18 at the oppositely disposed side is formed as a ramp 29 so that the locking element 14, which is wedge-shaped in cross-section, is pressed against the spring arm 27 by the pushing into the guide passage. For this purpose, the locking element 14 has sliding surfaces 38 with which it slides on the ramp 29 as well as pressure surfaces 37 on the oppositely disposed side with which it is pressed against the leaf spring in the locking position shown in FIG. 7B.

An abutment region 48 is in this respect formed as a counter-element behind the spring arm 2 of the spring element with respect to the guide passage and the spring arm is pressed against said abutment region in the locking position so that the spring arm is in a defined position between the abutment region 48 and the pressure surfaces 37 of the locking element 14 in the end position shown in FIG. 7B.

The locking element furthermore has an elastic element 31 in the form of a spring arm which passes through a slit-shaped opening in the spring arm 27 and is in contact with the abutment region 48. The elastic element 31 in the installation position shown in FIG. 7A in this respect ensures that no knocking of the locking element in the guide passage can be determined despite the wider guide passage at this position. The elastic element 31, in contrast, has no function for the locking itself. The locking is rather provided by the pressure surfaces 37 arranged next to this elastic element. The pressure surfaces can, however, not be recognized in this respect in the sectional views in FIG. 7A and 7B since the section passes through the central axis of the antenna module and thus of the locking element 14 and thus through the elastic element 31.

Figure 8:
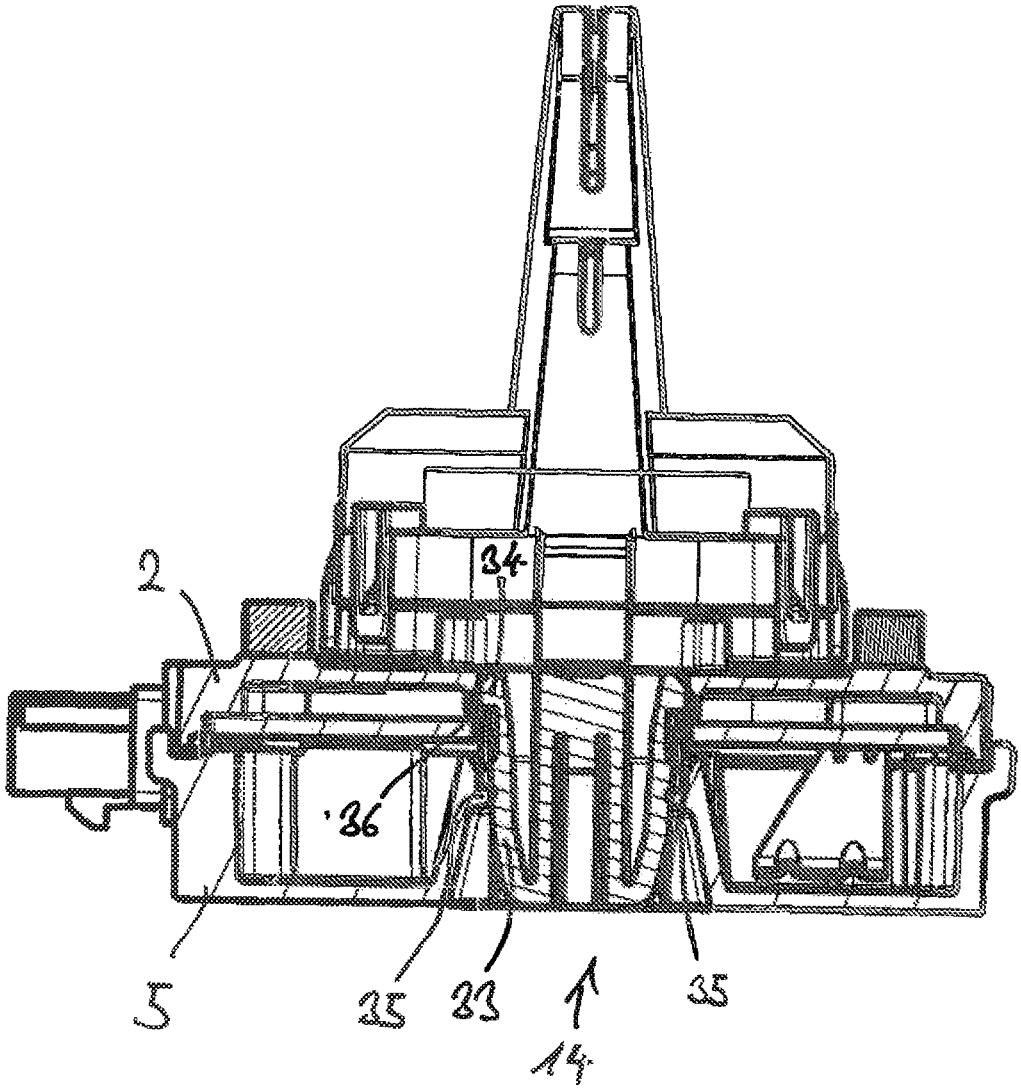
FIG. 8 shows a partial sectional view through the embodiment in a plane perpendicular to the central plane at a position which passes through the locking element, with the locking element in its locking position.
Figure 9:
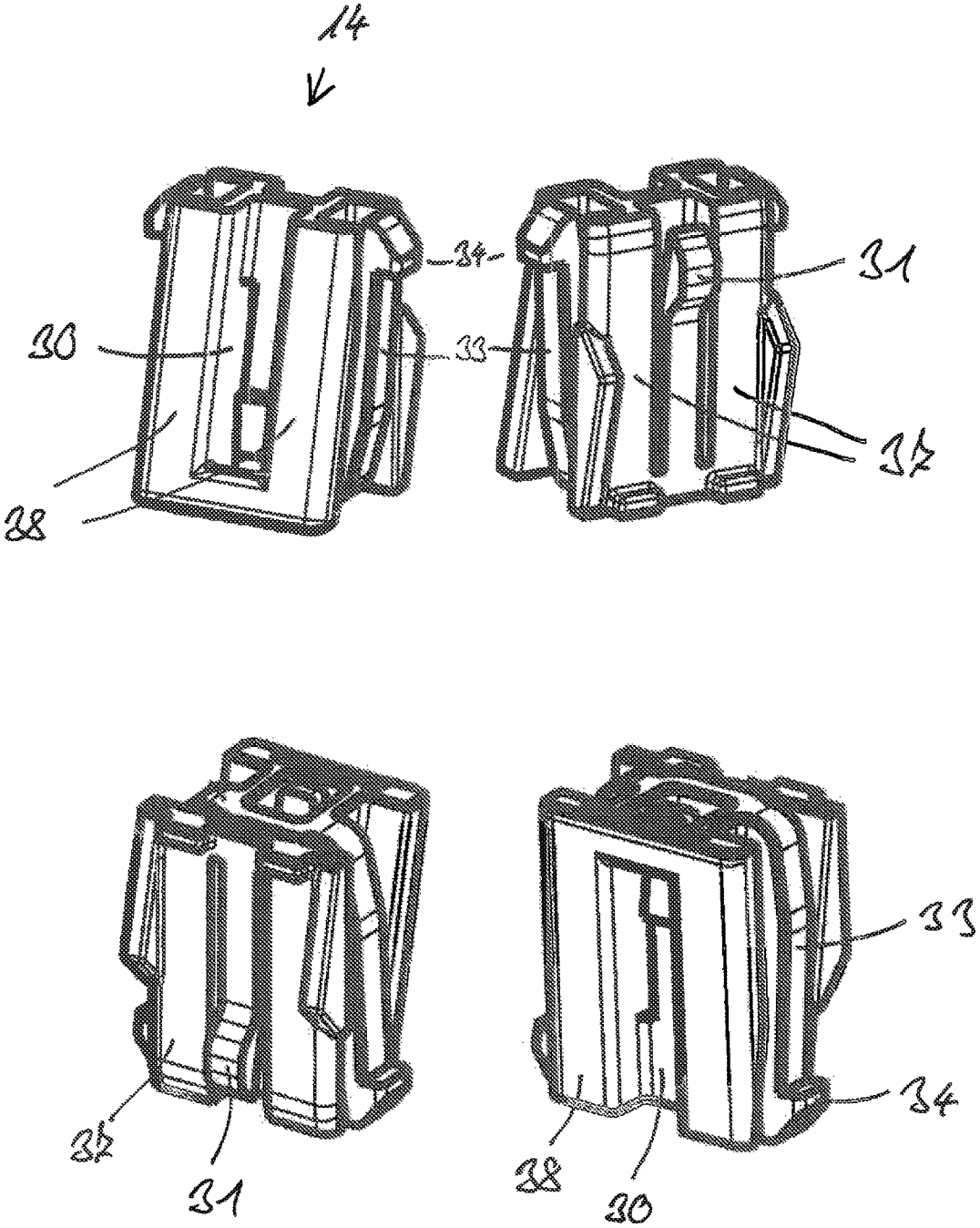
FIG. 9 shows four perspective representations of the locking element.
Figure 10:
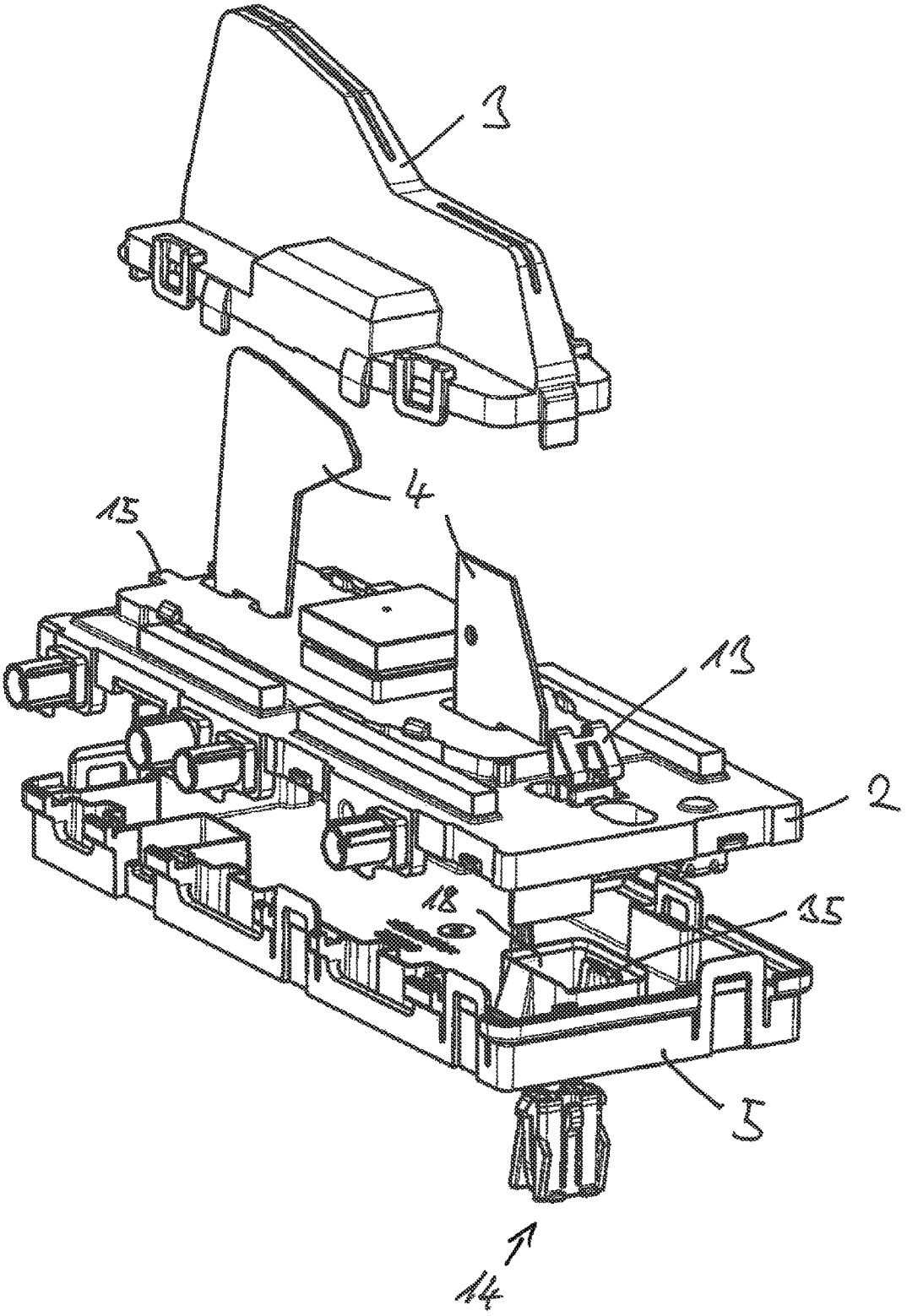
FIG. 10 shows an exploded representation of the embodiment in a view obliquely from the front and from above.
Figure 11:
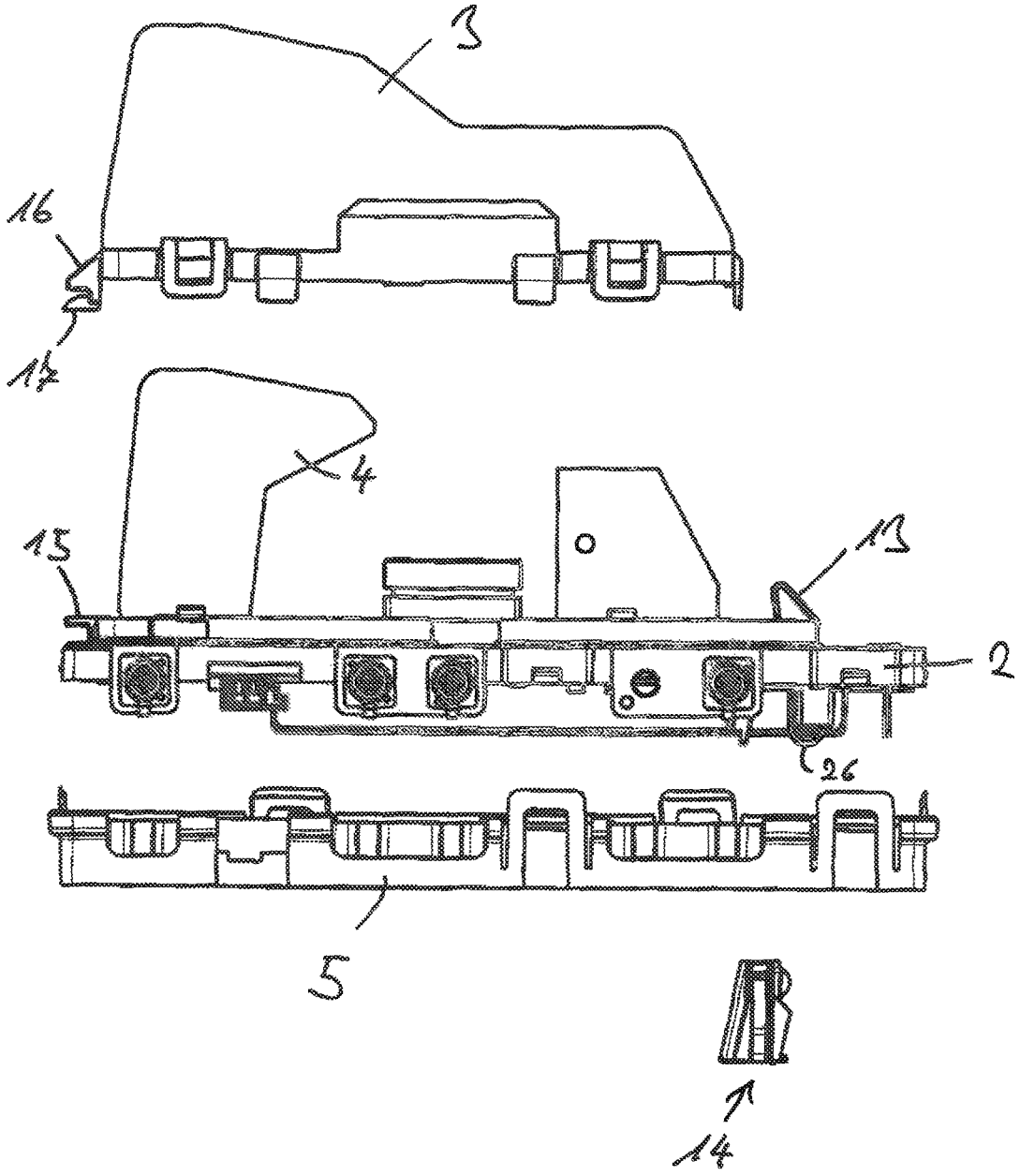
FIG. 11 shows an exploded representation of the embodiment in a side view.
Figure 12:
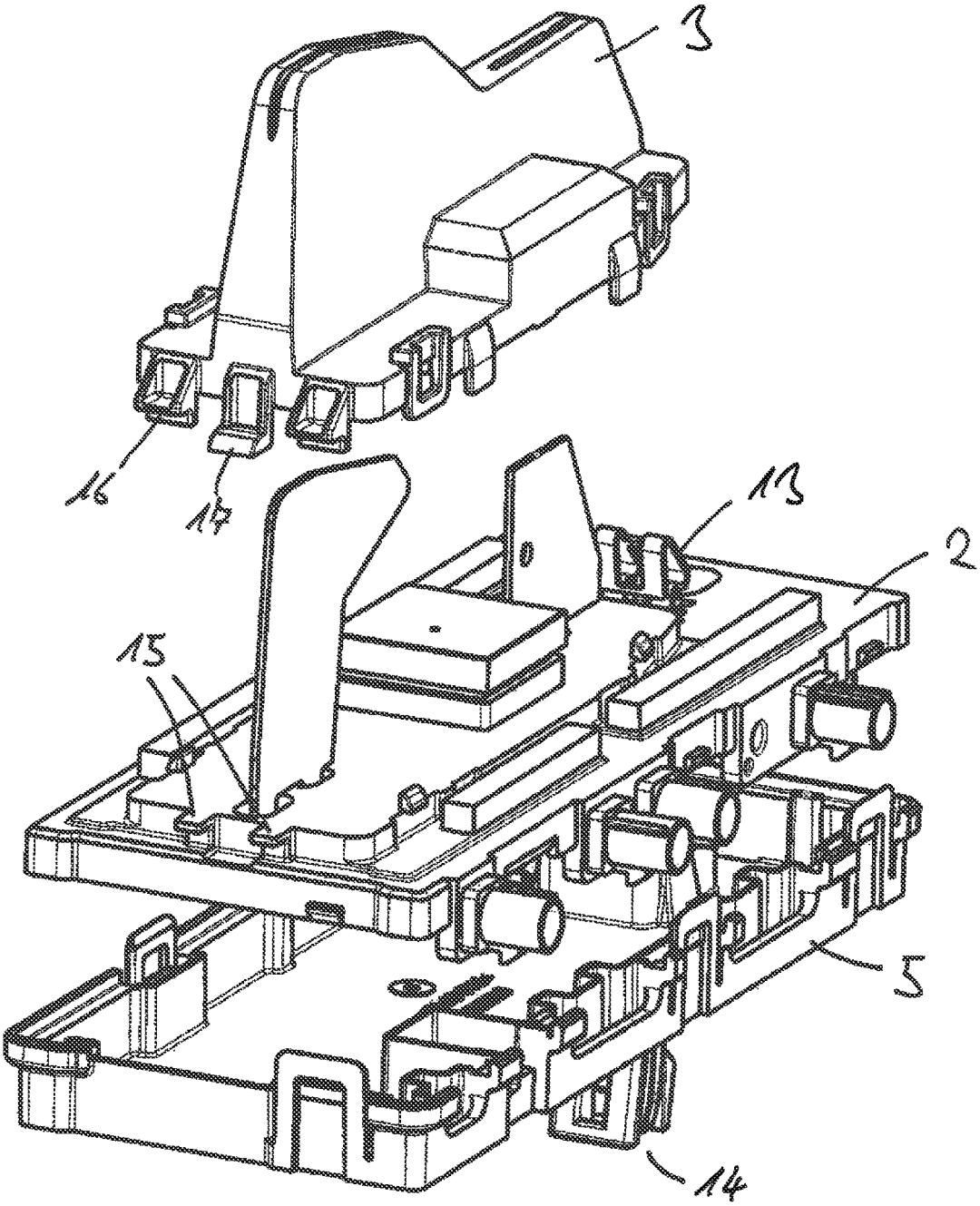
FIG. 12 shows an exploded representation of the embodiment in a perspective representation obliquely from the rear and fro above.
Figure 13:
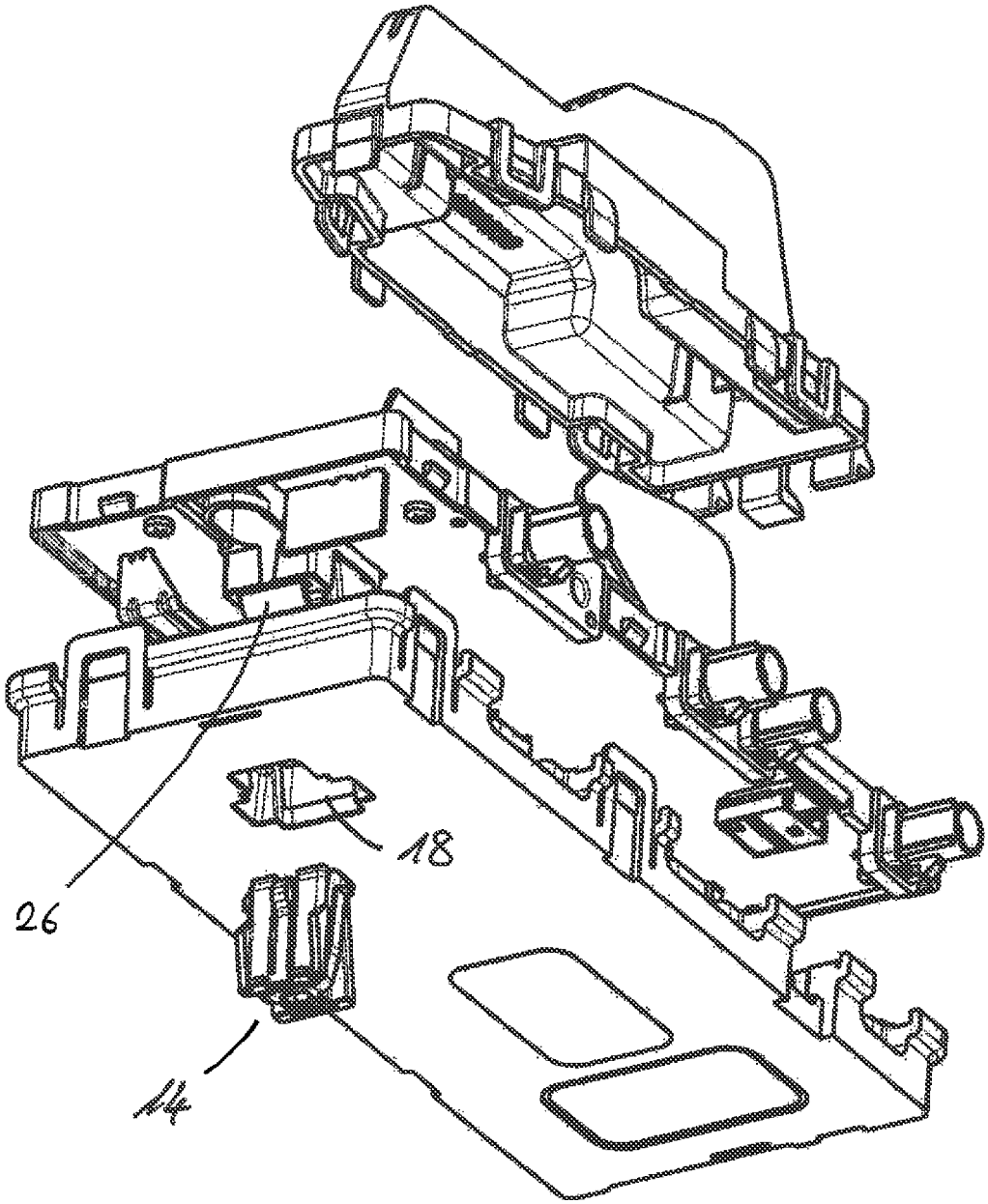
FIG. 13 shows an exploded representation of the embodiment in a perspective view obliquely from the front and from below.
Figure 14:
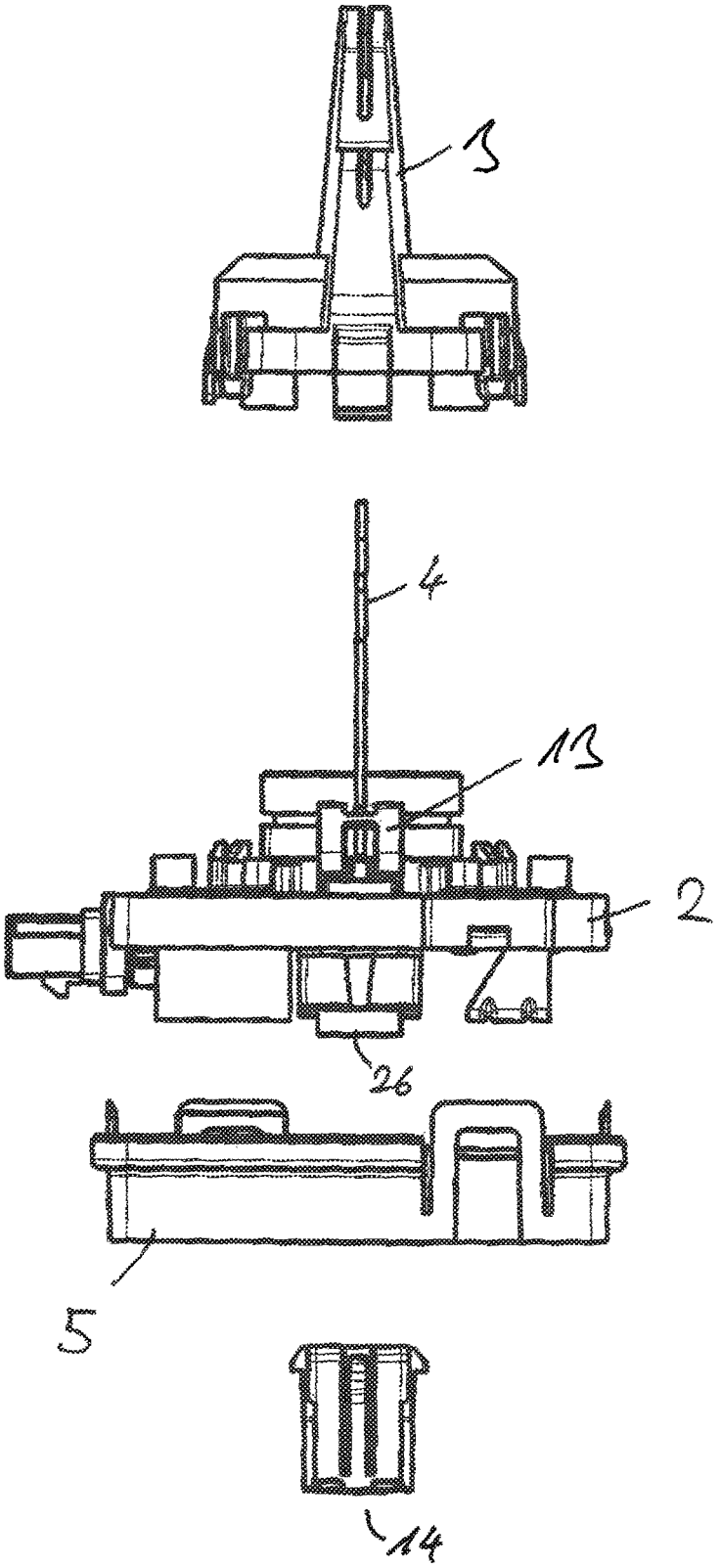
FIG. 14 shows an exploded representation of the embodiment in a view from the front.

The locking element 14 is pre-latched at the antenna module in the installation position shown in FIG. 7A so that the locking element cannot be lost. The locking element is furthermore also latched at the antenna module in the locking position shown in FIG. 7B. For this purpose, the locking element has the latching arms 33 which can be recognized in FIGS. 8 and 9 and which are arranged on oppositely disposed sides of the locking element. The latching arms 33 in this respect have a latching edge 34 which cooperate, on the one hand, with a counter-edge 35 for providing the pre-locking and with a further counter-edge 36 for providing the locking in the locking position. The first counter-edge 35 for the pre-locking is in this respect provided at the cap 5, see also FIG. 10; the second locking edge 36 for the locking in the locking position at the chassis 2, see FIG. 8.

The latching of the locking element in the guide passage can be released again in that the two latching arms 33 are, for example, gripped and pressed together using flat-nosed pliers. The locking element can then also be completely removed from the guide passage using the flat-nosed pliers.

The locking element 14 furthermore has a guide groove 30 by which it is guided on a guide rail 29 of the guide passage. The guide rail 29 is in this respect arranged on the side of the guide passage disposed opposite the spring element and forming a ramp.

The locking element is produced as an injection-molded part and from plastic in the embodiment.

In this respect, for the installation of the antenna module, after the antenna module has been pre-latched at the opening, the locking element is pressed into the guide passage so that it blocks the spring element and prevents spring movements of the spring element which could result in a release of the latch connection.

The antenna module can in this respect be dismantled again in a non-destructive manner to repair or replace it in the event of a defect. For this purpose, the locking element 14 is released from its locking position and removed from the guide passage 18. The contact edge 32 of the spring element is thereupon accessible from below, for example by a screwdriver, so that the latch connection of the spring element can be released. The antenna module can then again be installed at the vehicle roof by the method already shown above for the first installation.

The dismantling is possible completely from the passage compartment in this respect. It must be noted in this respect that the vehicle manufacturers typically install a further covering hood over the antenna module which is adhesively bonded to the vehicle roof. If the antenna module can now be completely dismantled from the passenger compartment of the vehicle, this additional covering hood does not have to be removed, which considerably simplifies the dismantling.

The embodiment shown in the Figures in this respect has a cut-out 20 in the chassis which comes to lie beneath a corresponding cut-out in the vehicle roof. A guide pin of the further covering hood, which is applied to the vehicle roof from the outside, can engage into this cut-out.

The following modified embodiments are also conceivable alternatively to the embodiment shown with reference to the Figures.

In a first alternative embodiment, the holding elements 15 and 16 could be dispensed with and a further spring element in accordance with the present disclosure having a further locking element in accordance with the present disclosure could be used in their place. The two locking elements could in this respect optionally also be combined to one locking element. In such an embodiment, the total antenna module could then simply be pushed into the opening of the vehicle roof and latched there via the spring elements. The final securing would then take place via the locking element or elements. In this respect, still further latch elements, which do not have any locking apparatus, could optionally be used.

Furthermore, in alternative embodiments, the positions of the holding elements and of the spring element described with respect to the above-described embodiment could be changed and, for example, swapped over.

The present disclosure can furthermore also be used in such antenna modules in which the installation does not take place from the passenger compartment of the vehicle, but rather from the outside. The peripheral regions of the chassis of the antenna modules can in this respect in particular be arranged above the vehicle roof, with the electronic contacting of the antenna module taking place through the opening of the vehicle roof. The fastening to the vehicle roof can in this respect take place in an analog manner such as is the case in the embodiment shown in the Figures. For this purpose, for example, the extent of the spring element and of the guide passage could be reversed so that the locking element then has to be pressed into the guide passage from top to bottom to move it into its locking position.

It would, however, also alternatively be possible that the locking element is not pressed into the chassis from the side from which the antenna module is inserted into the opening. In this case, the shape of the guide passage and/or of the locking element would be adapted accordingly to be able to block the spring element. The insertion of the antenna module could then, for example, take place from above; the actuation of the locking element from the passenger compartment.

However, the installation of the antenna module shown in the specific embodiment completely from the passenger compartment of the vehicle is to be preferred over even only a partial installation from outside since the antenna module can, as shown above, be replaced in a non-destructive manner without a further covering hood adhesively bonded to the vehicle roof having to be removed.

In a further variant of the present disclosure, the spring element could also be arranged at the roof panel and could latch with a counter-element at the antenna module. The locking in this case could in turn take place via a pusher element which blocks the spring path. Starting from the roof, the spring element could here also pass through a guide passage in the antenna module which simultaneously serves as a guide passage for the locking element designed as a pusher.

The variant of the present disclosure shown in the specific embodiment in which the spring element is arranged at the antenna module is, however, to be preferred over such a variant in which the spring element is fastened to the vehicle roof since only one cut-out hereby has to be provided in the vehicle roof.

In a further alternative embodiment, the locking element could also be arranged displaceable from the side into a guide passage instead of from the bottom. In this case, the locking element could also be pushed into the spring path of the spring element in order to block it against unwanted spring movements and/or to press the spring element into its end position. The guide passage and the locking element could in this respect be configured as described in the specific embodiment, wherein only the guide passage would pass through the housing substantially in parallel with the main plane thereof. Only the pressure surfaces of the locking element with which the latter presses against the spring arm of the spring element should be provided with a run-on chamfer. In such an embodiment, the guide passage would also not have to have any ramp and the locking element would not have to have any wedge shape. It would also be conceivable in this respect to guide the guide passage completely through the housing from one side to the other so that the pusher can be actuated from both sides and the unlocking can thus also take place by a manual displacement of the locking element.

Alternatively to the embodiment of the locking element as a pushing element shown in the embodiment, it would also be conceivable to arrange the locking element in a rotary manner at the antenna module. An eccentric element could, for example, be used here which serves as a locking element and blocks the spring element. The eccentric outer side of such an eccentric element could press onto a spring arm of the spring element and thus block it or move it into its end position. The eccentric element in this case has a flat point with which it lies on the spring arm in the locking position and is hereby secured in this position in a self-locking manner.

Independently of the specific embodiment of the spring element and of the locking element, the force which has to be applied to insert the antenna element into the opening of the vehicle roof amounts to a maximum of 50 N. The force which has to be applied for actuating the locking element and in particular for moving the locking element into the locking position furthermore amounts to a maximum of 15 N. This allows a simple assembly of the antenna module by hand.

The invention claimed is:

1. An antenna module for installation at an opening of a vehicle roof:

wherein the antenna module is arrangeable at the opening and is latchable there via a spring element;

wherein a fastening of the antenna module to the vehicle roof is securable via a locking element which, in its locking position, blocks a resilient backward movement of the spring element from a latched position;

wherein the locking element is actuable from a same side from which the antenna module is also arrangeable at the opening of the vehicle roof; and wherein, when the locking element is transitioned between an installation position and the locking position, a surface area of an adjoining interface formed between an abutment region of the locking element and a spring arm of the spring element is increased.

2. The antenna module in accordance with claim 1, wherein the antenna module is arrangeable at the opening of the vehicle roof from a vehicle interior; and/or wherein the locking element is actuable from the vehicle interior; and/or wherein the locking element is actuable in a tool-free manner.

3. The antenna module in accordance with claim 1, wherein the locking element is releasably fixed to the antenna module in the locking position by at least one of a latching connection, self-locking, or clamping; and/or wherein a locking of the spring element by the locking element and/or the fastening of the antenna module by the spring element is releasable in a non-destructive manner and/or is releasable from an installation side and/or from a vehicle interior.

4. The antenna module in accordance with claim 1, wherein the spring element is preloaded into an intermediate position in which it provisionally secures the antenna module after the arrangement at the opening of the vehicle roof, with the spring element only being moved against its spring force by the locking element from the intermediate position into an end position in which it permanently fixes the antenna module.

5. The antenna module in accordance with claim 1, wherein the locking element is movable into a spring path of the spring element to block it; and/or wherein the locking element is movable from the installation position, in which it allows a resilient movement of the spring element, into the locking position, with the locking element already being fastened to the antenna module in the installation position; and/or wherein the locking element is arranged displaceably or rotatably at the antenna module, wherein the locking element is a pushing element and/or an eccentric element.

6. The antenna module in accordance with claim 1, wherein the locking element has a latching arm with which the locking element is latchable to the antenna module, with the locking element being pre-latched at a first latching edge of the antenna module in the installation position and being fixed at a second latching edge of the antenna module in the locking position via the latching arm; and/or wherein the latching arm is releasable from a latching position via a tool to move the locking element back out of the locking position.

7. The antenna module in accordance with claim 1, wherein the spring element has a latching edge with which the spring element engages around a counter-edge in the latched position; and/or wherein the spring element has a run-on chamfer which comes into contact with the counter-edge on an insertion of the antenna module into the opening of the vehicle roof and via which the spring element is deflected, wherein the spring element, in an end position, enters into a clamping connection with the counter-edge; and/or wherein the spring element is attached to the antenna module and the latching edge engages around a rim of the opening of the vehicle roof and clamps the rim of the opening of the vehicle roof in the end position, with the spring element further being fastened to a chassis of the antenna module.

8. The antenna module in accordance with claim 7, wherein the spring element at least partly comprises spring steel, with the latching edge and the run-on chamfer being formed by bends of the spring steel, with a free end of the spring steel being engageable to release the spring element from the latched position, with the spring arm of the spring element having a U-shaped bend starting from a fastening region, with the locking element being arranged on a side of the spring arm disposed opposite the latching edge in the locking position and thereby blocking a movement of the spring arm out of the latched position.

9. The antenna module in accordance with claim 1, further comprising a guide along which the locking element is displaceable into the locking position, wherein the guide is a guide passage in which the locking element is displaceable, with the guide passage having a guide rail or guide groove which cooperates with a guide groove or guide rail of the locking element; and/or wherein the spring element extends on a side of the guide passage and is contacted by the locking element in the locking position.

10. The antenna module in accordance with claim 9, wherein the locking element comprises a pusher which is displaceable obliquely to an extension direction of the spring arm of the spring element in the guide and/or has a run-on chamfer and/or has a wedge-shaped form so that, during displacement into its locking position, the locking element is pressed against the spring arm of the spring element, with the guide being formed by a ramp-shaped wall of the guide passage which is disposed opposite the spring arm; and/or wherein the locking element has an elastic element with which it is supported against the guide passage and/or the spring element to achieve a wobble-free seat of the locking element in an installation position.

11. The antenna module in accordance with claim 1, further comprising a holding element which engages around a rim of the opening of the vehicle roof, with the holding element being arranged at the antenna module at a side disposed opposite the spring element with respect to the opening; and/or wherein the holding element is configured as a rigid element and/or has an edge with which it is laterally pushable onto the rim of the opening of the vehicle roof, and/or wherein a ramp is associated with the rim such that the rim of the vehicle roof is clampingly fixable and/or wherein the holding element allows a pivot movement about a fixing point provided by the holding element, and/or wherein at least a first holding element is provided at a chassis and at least a second holding element is provided at a cover of the antenna module, with the first holding element at the chassis being held out of contact with the vehicle roof by the second holding element at the cover.

12. The antenna module in accordance with claim 1, further comprising a chassis which carries one or more antennas on its upper side, with the chassis comprising metal or comprising a metallic layer, with the chassis arranged beneath or on the vehicle roof with a peripheral region of the chassis and having a base region with which it passes through the opening in the vehicle roof, with the chassis having coupling elements in its peripheral region, via which coupling elements the chassis is coupled electrically to the vehicle roof, with the antenna module further having a cover for the one or more antennas which is fastenable to the upper side of the chassis and/or having a cap which closes the chassis toward a bottom.

13. The antenna module in accordance with claim 12, wherein a guide passage for the locking element is provided which passes through the antenna module from the bottom to a top and which is formed at the cap and/or chassis, wherein a contact edge of the spring element that is engageable to release a latching connection is accessible through the guide passage.

14. The antenna module in accordance with claim 9, wherein the locking element comprises a pusher which is displaceable obliquely to an extension direction of the spring arm of the spring element in the guide, with the guide being formed by a ramp-shaped wall of the guide passage which is disposed opposite the spring arm and wherein the locking element has an elastic element with which it is supported against the guide passage.

15. The antenna module in accordance with claim 1, wherein the locking element is actuable in a tool-free manner.

16. The antenna module in accordance with claim 1, wherein the locking element has a plurality of latching arms with which the locking element is latchable to the antenna module, with the locking element being prelatched at a first latching edge of the antenna module in the installation position and being fixed at a second latching edge of the antenna module in the locking position via the plurality of latching arms; and wherein the plurality of latching arms is releasable from a latching position via a tool to move the locking element back out of the locking position.

17. The antenna module in accordance with claim 1, wherein the spring element has a latching edge with which the spring element engages around a counter-edge in the latched position;

wherein the spring element has a run-on chamfer which comes into contact with the counter-edge on an insertion of the antenna module into the opening of the vehicle roof and via which the spring element is deflected;

wherein the spring element, in an end position, enters into a clamping connection with the counter-edge; and wherein the spring element is attached to the antenna module and its latching edge engages around a rim of the opening of the vehicle roof and clamps the rim of the opening of the vehicle roof in the end position, with the spring element further being fastened to a chassis of the antenna module.

18. The antenna module in accordance with claim 1, wherein the locking element is movable from the installation position, in which it allows a resilient movement of the spring element, into the locking position, with the locking element already being fastened to the antenna module in the installation position;

wherein the locking element is arranged displaceably or rotatably at the antenna module; and wherein the locking element is a pushing and an eccentric element.

19. An antenna module attached to an opening of a vehicle roof:

wherein the antenna module is arranged at the opening and latched there via a spring element;

wherein the antenna module is secured at the opening via a locking element which, in its locking position, blocks a resilient backward movement of the spring element from a latched position; and wherein the locking element is actuable from a same side from which the antenna module is also arrangeable at the opening of the vehicle roof;

wherein the spring element has a spring arm that is resiliently moveable along a spring path between an unlatched position and the latched position;

wherein the locking element is movable relative to the spring element from an installation position into the locking position, wherein in the installation position the locking element permits a resilient movement of the spring arm along the spring path; and wherein, when the locking element is transitioned from the installation position into the locking position, the locking element is moved into the spring path of the spring element such that an abutment region of the locking element interfaces with the spring arm to block resilient backward movement of the spring arm from the latched position.

* * * * *